US008439625B2

(12) United States Patent
Pass et al.

(10) Patent No.: US 8,439,625 B2
(45) Date of Patent: May 14, 2013

(54) INSPECTION SYSTEM FOR ROLLED PRODUCTS AND METHOD FOR ASSESSING THE SURFACE OF ROLLED PRODUCTS OF A ROLLING INSTALLATION

(75) Inventors: Gisbert Pass, Dorsten (DE); Wilfried Modrow, Solingen (DE); Heinz-Adolf Mueller, Wilnsdorf (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 373 days.

(21) Appl. No.: 12/452,725

(22) PCT Filed: Jul. 18, 2008

(86) PCT No.: PCT/EP2008/005911

§ 371 (c)(1),
(2), (4) Date: Mar. 8, 2010

(87) PCT Pub. No.: WO2009/012946

PCT Pub. Date: Jan. 29, 2009

(65) Prior Publication Data

US 2010/0196133 A1 Aug. 5, 2010

(30) Foreign Application Priority Data

Jul. 20, 2007 (DE) ..... 10 2007 034 424
Jun. 5, 2008 (DE) ..... 10 2008 026 947
Jul. 18, 2008 (DE) ..... 10 2008 033 909

(51) Int. Cl.
*B21B 39/22* (2006.01)
*B65G 47/252* (2006.01)

(52) U.S. Cl.
USPC ..... 414/759; 414/771; 414/736

(58) Field of Classification Search ..... 198/402–403; 414/754, 758–761, 764, 769, 771, 773–774, 414/783
See application file for complete search history.

(56) References Cited

U.S. PATENT DOCUMENTS 591,712 A * 10/1897 Worth ..... 198/403
1,973,816 A * 9/1934 Kruckenberg et al. ..... 384/595
3,289,811 A * 12/1966 Kelley ..... 414/791.3
3,386,598 A * 6/1968 Ferko ..... 414/771
3,430,781 A * 3/1969 Nectoux ..... 414/779
3,529,710 A * 9/1970 Fiegel, Jr. ..... 198/379
3,581,910 A 6/1971 Field et al.
3,589,532 A * 6/1971 Filkins ..... 414/759
3,780,882 A 12/1973 Wagner
3,884,516 A * 5/1975 Gallion et al. ..... 293/120

(Continued)

FOREIGN PATENT DOCUMENTS

DE 1158026 11/1963
DE 2165936 7/1973

(Continued)

*Primary Examiner* — Gregory Adams
(74) *Attorney, Agent, or Firm* — Abelman, Frayne & Schwab

(57) ABSTRACT

The invention relates to an inspection system 10 for rolled products 20 of a milling station, comprising at least one plate turning device 11 with an arrangement of transferring turning arms 12 located on a turning shaft 14 and of receiving turning arms 13 located on a turning shaft 15. According to the invention it is thereby provided that the turning shaft 15 of the receiving turning arms 13 is arranged offset with respect to the turning shaft 14 of the transferring turning arms 12. The invention relates in addition to a method for examination of the surface of rolled products 20 of a milling station.

4 Claims, 4 Drawing Sheets

U.S. PATENT DOCUMENTS

Figure 1:
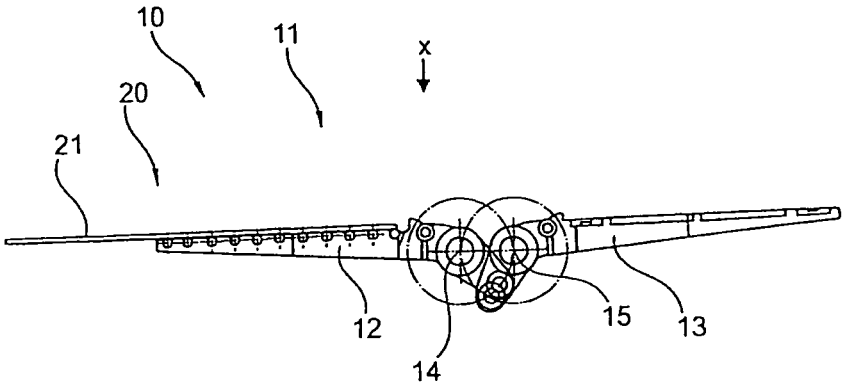

| | | | | |
|---|---|---|---|---|
| 5,395,153 | A * | 3/1995 | De Smet | 296/146.6 |
| 6,499,170 | B2 * | 12/2002 | Kim et al. | 14/73.5 |
| 2006/0165513 | A1 | 7/2006 | Tiepelmann | |

FOREIGN PATENT DOCUMENTS

| | | | |
|---|---|---|---|
| DE | 3123673 | | 12/1982 |
| GB | 2099345 | | 12/1982 |
| JP | 47002509 | | 1/1972 |
| JP | 11246075 | A * | 9/1999 |
| JP | 2003276828 | A * | 10/2003 |
| JP | 2008246552 | A * | 10/2008 |
| RU | 2 240 969 | | 11/2004 |
| SU | 583908 | | 12/1977 |
| SU | 788206 | | 12/1980 |

* cited by examiner

INSPECTION SYSTEM FOR ROLLED PRODUCTS AND METHOD FOR ASSESSING THE SURFACE OF ROLLED PRODUCTS OF A ROLLING INSTALLATION

The invention relates to an inspection system for rolled products of a milling station, comprising at least one plate turning device with an arrangement of transferring turning arms located on a turning shaft and of receiving turning arms located on a turning shaft. The invention relates in addition to a method for examination of the surface of rolled products of a milling station.

As a basic principle, for examination of the surface of rolled plates, the same are turned in the inspection bed by means of a plate turning device. An arrangement of turning arms on a turning shaft lift the plate from the inspection bed on the entry side and turn it until it stands vertical, and the receiving arms turn the plate further until it is placed down horizontally again on the inspection bed. During the transfer between transferring and receiving turning arms, very loud operational noises arise. They are generated by the so-called turn-over from one side to the other and the spring-back of the plate. The spring-back results in vibrations of the plate.

With regard to the background art, exemplified is referred to the following publications:

EP 1 590 106 B1 relates to an inspection system for rolled products of a milling station consisting of two inspection tables. Here it is provided that the two inspection tables are arranged adjacent to one another on one and the same plane, that in front of the two inspection tables as seen in conveying direction of the rolled products is a turning device, in which two receiving elements for rolled products are pivotable about a rotational axis aligned substantially parallel to the extension plane of the rolled products, that the rotational axis of the receiving elements is oriented in conveying direction of the rolled products, that the receiving elements are arranged with mirror symmetry parallel to the rotational axis, that a receiving element is arranged upstream of each inspection table, and that a rolled product can be conveyed to the respective inspection table.

In the preferred embodiment, each receiving element comprises at least one pair of conveyor belts which lie in two planes and which have a mutually opposite rotational direction and a corresponding conveying direction of the rolled products. Preferably the conveyor belts are provided with a number of fixing elements, furthermore, these fixing elements for rolled products are preferably formed as magnets.

With an inspection system formed in this manner, it is allowed to examine both sides of the rolled product by an examiner at an ergonomically convenient height. The described arrangement is based on the consideration that it is unfavorable for the ergonomics, here that is, the performance and the optimal working conditions of the examiner, to carry out the inspection of the rolled product on two planes. Hence the inspection system should be designed to allow the examination of the upper side as well as, after a rotation of 180 degrees of the rolled product, of the lower side on one working plane, thus to maintain the working plane for both conditions. This should be possible by means of the turning device which is formed accordingly. For this reason, for the ergonomically convenient inspection of the upper and lower side of the rolled product on one and the same plane, the turning device is equipped with two receiving elements for rolled products, which are pivotable about a rotational axis which is aligned substantially parallel to the extension plane of the rolled product.

DE 31 23 673 A1 relates to a reversible plate tilter having two groups of turning arms which are provided with noses for supporting the plate to be turned and which are driven pivotable about horizontal pivot axes such that, depending on the turning direction, always the one group of turning arms reaches the dead-point position exceeding the vertical position earlier than the other one, after which both groups move over the intersection of their swing movements in the region of the vertical center line in the same direction, and the upright-positioned plate carried by the noses of the arms which have not yet reached the dead-point position is thereby engaged and received by the noses of the other group of arms. Thereby it is provided that the supporting width of the noses of the turning arms is adapted to the maximum thickness (e.g. 400 mm) of the plates to be turned and the bearings for the pivot axis of at least one group of turning arms are adjustable in horizontal direction. In a preferred arrangement, it is provided that the bearings for both pivot axes are adjustable in opposite directions, and furthermore, it can be provided that each group of turning arms is driven independently from the other group, wherein preferably the pivot drives comprise hydraulic pivot cylinders. With such a plate tilter, the object is to be solved to make such a plate tilter usable for thin as well as for very thick, slab-like plates without the risk that thin plates, during transfer from one group of turning arms to the other group, fall over with a high generation of noise because with respect to the turning of very thick plates, the thin plates have too much clearance.

Of disadvantage in the known inspection systems for rolled products of a milling station with a plate turning device and the corresponding methods for examination of the surface of rolled products of a milling station is in particular, as mentioned, the very loud operational noise generated during the transfer between transferring and receiving turning arms; a reduction of the occurring generation of noise and vibrations would be desirable here.

With this background, the invention is based on the object to improve or further develop, respectively, the known devices and methods while maintaining the existing advantages in such a manner that the mentioned disadvantages are avoided, wherein in particular a considerable reduction of the occurring generation of noise and vibrations is to be achieved.

This object is solved with respect to the inspection system according to the invention in that the turning shaft of the receiving turning arms is arranged offset with regard to the turning shaft of the transferring turning arms. The receiving turning arms thus are arranged offset with regard to the turning shaft of the transferring turning arms. Thereby the plate does not strike as a whole from one side to the other, but this happens rather time-delayed with respect to the plate length, depending on the distance of the individual turning arms to each other over the length of the turning shafts and on the degree of the offset of the turning arms or their turning shafts, respectively. The reception of the plate takes place in the manner of a sine function. By means of the offset of the turning arms, thus a "smooth" transfer of the plate is achieved. This results in a substantial noise reduction and a decrease of the vibrations, whereby in particular a better environmental protection as well as lower operational cost are obtained, since, for example, no or less noisy work places exist.

In the preferred embodiment of the present invention, the receiving turning arms comprise at least one, preferably two damping elements. The damping elements can preferably be formed as damping plates. By means of these damping elements, which are attached to the receiving turning arms, the turning-over of the plate onto the receiving arm is dampened, the striking noise of the plate turning over, in particular of the first strike is considerably reduced. This dampening results also in a reduced wear.

According to a further feature of the present invention, it is provided that the receiving turning arms comprise at least one or, according to a last feature of the invention with regard to the inspection system, two electromagnets. By means of these electromagnets, a striking back of the plate and a subsequent vibrating of the plate along with generation of noise is prevented. These electromagnets are turned on, e.g. during the time period of the transfer and the turn-over from the transferring to the receiving turning arms.

The object on which the invention is based on is solved according to the invention with respect to the method in that during the transfer, the turning shaft of the receiving turning arms is arranged offset with regard to the turning shaft of the transferring turning arms. With respect to the resulting advantages, for the purpose of avoiding repetitions, it is referred to the described advantages of the inspection system according to the invention.

In the preferred embodiment of the method according to the invention it is provided that the transfer is dampened by at least one, preferably two damping elements arranged at the receiving turning arms.

It is recommended according to a further feature of the method according to the invention that during the transfer a back striking of the rolled product and a subsequent vibrating of the same along with a generation of noise is prevented by at least one or, according to a last feature of the method according to the invention, by preferably two electromagnets arranged at the receiving turning arms.

Figure 2:
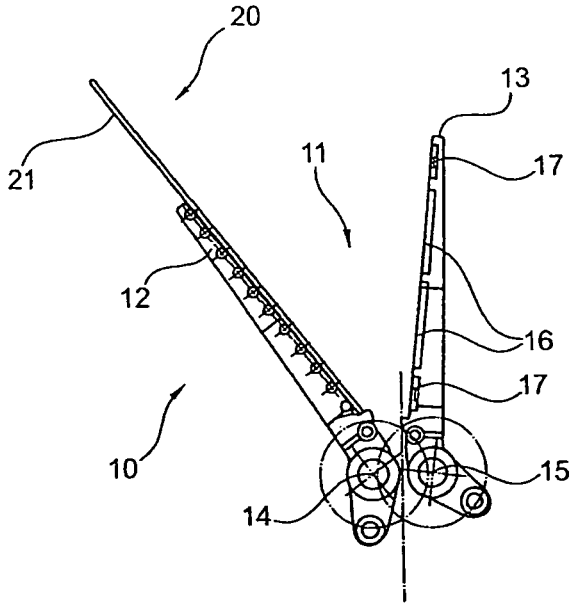
Figure 3:
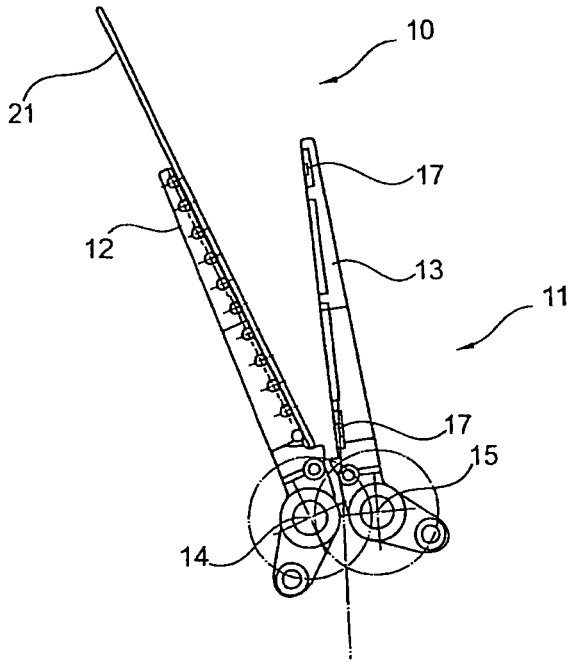
Figure 4:
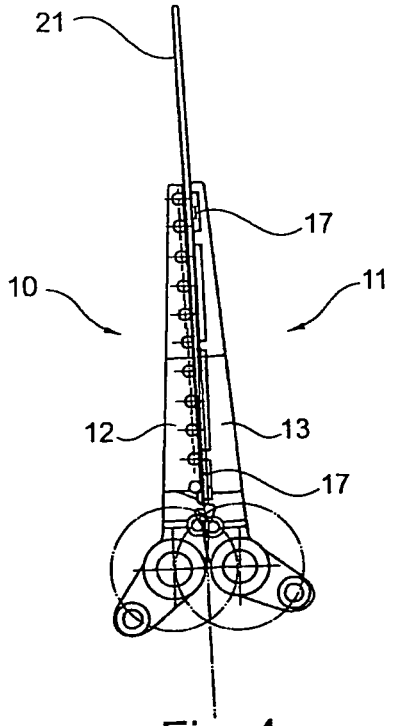
Figure 5:
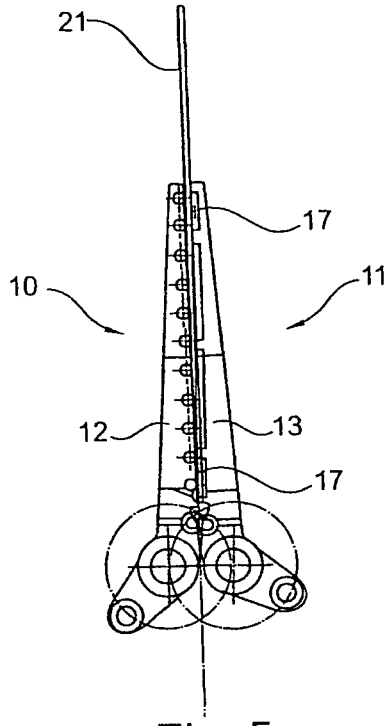
Figure 6:
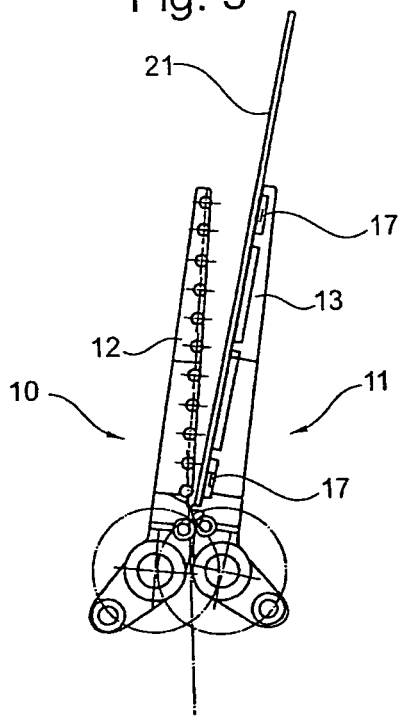
Figure 7:
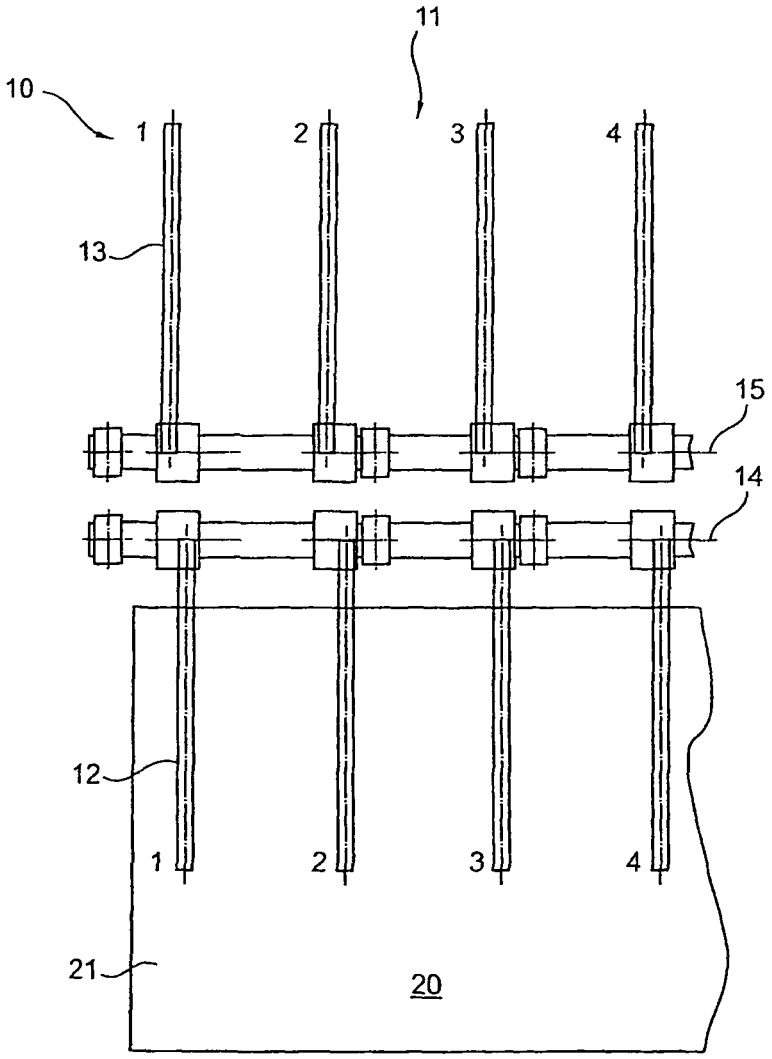

Further advantages and details of the invention are apparent from the sub-claims and from the following description, in which the embodiment of the invention illustrated in the figures of the drawing is explained in more detail. Here, besides the above mentioned combinations of features, features on their own or in other combinations are also essential for the invention. In the figures, FIG. 1 shows a schematic side view of the plate turning device of the inspection system according to the invention in a first functional position, FIG. 2 shows the schematic side view of the plate turning device of the inspection system according to the invention in a second functional position, FIG. 3 shows the schematic side view of the plate turning device of the inspection system according to the invention in a third functional position, FIG. 4 shows the schematic side view of the plate turning device of the inspection system according to the invention in a fourth functional position, FIG. 5 shows the schematic side view of the plate turning device of the inspection system according to the invention in a fifth functional position, FIG. 6 shows the schematic side view of the plate turning device of the inspection system according to the invention in a sixth functional position, FIG. 7 shows a schematic top view of the plate turning device of the inspection system according to the invention in direction of the arrow X of FIG. 1.

The inspection system according to the invention is generally indicated with 10 and is provided for rolled products, indicated here with 20, of a milling station. Thereto, in the Figs. of the drawing, a plate turning device 11 of the inspection system 10 according to the invention is illustrated in different functional positions. The inspection system 10 according to the invention thereby comprises at least one plate turning device 11 having an arrangement of transferring turning arms 12 located on a turning shaft 14 and of receiving turning arms 13 located on a turning shaft 15; thereto see first FIGS. 1 and 2 of the drawing. In the inspection system 10 according to the invention thereby it is provided that the turning shaft 15 of the receiving turning arms 13 is arranged offset with respect to the turning shaft 14 of the transferring turning arms 12. The receiving turning arms 13 thus are arranged offset with respect to the turning shaft 14 of the transferring turning arms 12. Thereby, the plate 21 does not strike as a whole from one side to the other side onto the receiving turning arm 13, but this happens rather time-delayed with respect to the plate length, depending on the distance of the individual turning arms 12, 13 to each other over the length of the turning shafts 14, 15 and on the degree of the offset of the turning arms 12, 13 or their turning shafts 14, 15, respectively. The reception of the plate 21 takes place in the manner of a sine function. By means of the offset of the turning arms 12, 13, thus a "smooth" transfer of the plate 21 is achieved. This results in a substantial noise reduction and a decrease of the vibrations, whereby in particular a better environmental protection as well as lower operational cost are obtained, since, for example, no or less noisy work places exist.

In the preferred embodiment of the present invention, the receiving turning arms 13 comprise at least one, preferably two damping elements 16. These damping elements 16 can preferably be formed as damping plates; this embodiment is shown in the Figs. of the drawing. Here is in particular referred to the FIG. 2 of the drawing. By means of these damping elements 16, which are attached to the receiving turning arms 13, the turning-over of the plate 21 onto the receiving arm 13 is dampened, and the striking noise of the plate 21 when turning over, in particular of the first strike, is considerably reduced. This dampening results also in a reduced wear. In this embodiment is further provided that the receiving turning arms 13 comprise at least one, in this case two, electromagnets 17. By means of these electromagnets 17, a striking back of the plate 21 and a subsequent vibrating of the plate 21 along with generation of noise is prevented. These electromagnets 17 are turned on, e.g. during the time period of the transfer and the turn-over from the transferring to the receiving turning arms 13.

In the Figs. of the drawing, the plate turning device 11 of the inspection system 10 is illustrated in different functional positions. FIG. 1 shows here the starting position with each of the turning arms 12, 13 arranged substantially horizontal, in FIG. 2, the transferring turning arm 12 moves towards the almost vertically standing receiving arm 13, in FIG. 3 the point of time of the transfer is almost reached. In the FIGS. 1, 2 and 3, all electromagnets 17 are turned off. FIG. 4 shows the point of time directly before the transfer of the plate 21 and FIG. 5 shows the point of time directly after; in both cases the electromagnets 17 are turned on. FIG. 6 finally shows the point of time after the transfer with the receiving turning arm 13 lowering; in this case the electromagnets 17 are turned off again. In FIG. 7, a top view of the plate turning device 11 of the inspection system 10 according to the invention is finally shown in direction of the arrow X of FIG. 1; here an embodiment with four transferring and four receiving turning arms 12, 13, respectively, is seen.

REFERENCE LIST

10 Inspection system
11 Plate turning device
12 Transferring turning arm
13 Receiving turning arm

14 First turning shaft (for 12)
15 Second turning shaft (for 13)
16 Damping element (on 13)
17 Electromagnet (on 13)
20 Rolled product
21 Plate

The invention claimed is:

1. An inspection system (10) for rolled products (20) of a milling station, comprising at least one plate turning device (11) having an arrangement of transferring turning arms (12) located on a first turning shaft (14) and of receiving turning arms (13) located on a second turning shaft (15), wherein the second turning shaft (15) of the receiving turning arms (13) is arranged with offset with respect to the first turning shaft (14) of the transferring turning arms (12), and the receiving turning arms (13) comprise two damping plates (16) arranged on the receiving turning arms (13), respectively, and wherein the receiving turning arms (13) comprise at least one electromagnet (17).

2. The inspection system according to claim 1, Wherein, the receiving turning arms (13) comprise two electromagnets (17).

3. A method for examination of the surface of rolled products (20) of a milling station by means of an inspection system (10), in which by means of at least one plate turning device (11) the rolled product (20) is transferred by transferring turning arms (12) located on a first turning shaft (14) to receiving turning arms (13) located on a second turning shaft (15), wherein during the transfer of the rolled product, the second turning shaft (15) of the receiving turning arms (13) is arranged with offset with respect to the first turning shaft (14) of the transferring turning arms (12), and the transfer is dampened by two damping plates (16) arranged on the receiving turning arms (13), respectively, and wherein during the transfer a striking back of the rolled product (20) and a subsequent vibrating of the same along with generation of noise is prevented by at least one electromagnet (17) arranged on the receiving turning arms (13).

4. The method according to claim 3, wherein during the transfer a striking back of the rolled product (20) a subsequent vibrating of the same along with generation of noise are prevented by two electromagnets (17) arranged on the receiving turning arms (13).

* * * * *